US012240028B2

(12) United States Patent
Beger

(10) Patent No.: US 12,240,028 B2
(45) Date of Patent: Mar. 4, 2025

(54) COMBINATION MACHINE FOR FOLDING AND DIE BENDING A WORKPIECE

(71) Applicant: Blech-Tec GmbH, Sauerlach/Altkirchen (DE)

(72) Inventor: Ralf Beger, Unterhaching (DE)

(73) Assignee: Blech-Tec GmbH (DE)

( * ) Notice: Subject to any disclaimer, the term of this patent is extended or adjusted under 35 U.S.C. 154(b) by 475 days.

(21) Appl. No.: 17/430,519

(22) PCT Filed: Feb. 20, 2020

(86) PCT No.: PCT/EP2020/054445
§ 371 (c)(1),
(2) Date: Aug. 12, 2021

(87) PCT Pub. No.: WO2020/169716
PCT Pub. Date: Aug. 27, 2020

(65) Prior Publication Data

US 2022/0314293 A1 Oct. 6, 2022

(30) Foreign Application Priority Data

Feb. 21, 2019 (DE) ..... 10 2019 104 502.9

(51) Int. Cl.
*B21D 5/02* (2006.01)
*B21D 5/00* (2006.01)
(Continued)

(52) U.S. Cl.
CPC ..... *B21D 5/0236* (2013.01); *B21D 5/004* (2013.01); *B21D 5/042* (2013.01); *B21D 21/00* (2013.01)

(58) Field of Classification Search
CPC ..... B21D 5/0236; B21D 5/004; B21D 5/042; B21D 21/00; B21D 5/0209; B21D 5/0254
(Continued)

(56) References Cited

U.S. PATENT DOCUMENTS 2,426,446 A * 8/1947 Funk ..... B21D 5/0254 72/429
2,438,057 A 3/1948 Kilham
(Continued)

FOREIGN PATENT DOCUMENTS

CN 2136700 Y 6/1993
CN 109175044 A 1/2019
(Continued)

OTHER PUBLICATIONS

AT 511959B1, Secibovic Apr. 2013.*
(Continued)

*Primary Examiner* — Edward T Tolan
(74) *Attorney, Agent, or Firm* — Dorton & Willis, LLP

(57) ABSTRACT

A combination machine for folding and die bending a workpiece includes a lower tool holder configured to releasably receive at least one lower bending tool; an upper tool holder configured to releasably receive at least one upper bending tool and which can be advanced in a straight line in an advancing direction toward the lower tool holder; a pivotable tool holder configured to releasably receive at least one bending tool to be pivoted and which can be pivoted relative to the lower tool holder about a pivot axis running perpendicular to the advancing direction of the upper tool holder; and a machine body on which the upper tool holder is arranged. The machine body is configured to absorb bending forces occurring in the advancing direction of the upper tool holder and bending forces occurring during pivoting of the pivotable tool holder depending on the progress of the bending process.

23 Claims, 11 Drawing Sheets

(51) Int. Cl.
*B21D 5/04* (2006.01)
*B21D 21/00* (2006.01)

(58) Field of Classification Search
USPC ..... 72/384
See application file for complete search history.

(56) References Cited

U.S. PATENT DOCUMENTS

| | | | | |
|---|---|---|---|---|
| 3,323,348 | A * | 6/1967 | Pearson | B21D 5/0209 72/413 |
| 3,495,435 | A * | 2/1970 | Eduard | B21D 5/0209 72/448 |
| 3,509,757 | A * | 5/1970 | Eduard | B21D 5/02 72/414 |
| 4,391,119 | A | 7/1983 | Schmitz | |
| 4,672,835 | A * | 6/1987 | Liet | B21D 5/0209 72/415 |
| 5,329,795 | A * | 7/1994 | Sartorio | B21D 5/02 72/21.4 |
| 5,927,135 | A * | 7/1999 | Kutschker | B21D 5/042 72/319 |
| 7,523,636 | B2 * | 4/2009 | Bessa Pacheco | B21D 5/0209 72/481.2 |
| 11,014,136 | B2 * | 5/2021 | Xu | B21D 5/02 |
| 2005/0160782 | A1 * | 7/2005 | Kutschker | B21D 5/02 72/319 |
| 2009/0013748 | A1 * | 1/2009 | Franze | B21D 5/042 72/31.11 |
| 2018/0311720 | A1 | 11/2018 | Cavicchia et al. | |

FOREIGN PATENT DOCUMENTS

| | | | |
|---|---|---|---|
| DE | 1076608 | B | 3/1960 |
| DE | 3106353 | A1 | 12/1981 |
| DE | 19730458 | A1 | 1/1999 |
| EP | 1797973 | A1 | 6/2007 |
| EP | 3061538 | A1 | 8/2016 |
| JP | S56-154224 | A | 11/1981 |
| JP | 2001-001052 | A | 1/2001 |

OTHER PUBLICATIONS

Translation AT 511959B1, Secibovic Apr. 2013.*
CH 668035A5, Dieperink Nov. 1988.*
JP 62-259620A, Furuyama Nov. 1987.*
Translation JP 62-259620A, Furuyama Nov. 1987.*
CN 2136700Y, Sun Jun. 1993.*
Japanese Patent Office; Office Action in related Japanese Patent Application No. 2021-549448 dated Jun. 27, 2023; 5 pages.
Chinese Patent Office; Office Action in related Chinese Patent Application No. 202080014822.9 dated Mar. 14, 2023; 10 pages.
European Patent Office; Search Report in related International Patent Application No. PCT/EP2020/054445 dated Jun. 9, 2020; 5 pages.
European Patent Office; Written Opinion in related International Patent Application No. PCT/EP2020/054445 dated Jun. 9, 2020; 6 pages.

* cited by examiner

COMBINATION MACHINE FOR FOLDING AND DIE BENDING A WORKPIECE

CROSS-REFERENCE TO RELATED APPLICATIONS

This application is a national phase application under 35 U.S.C. § 371 of International Patent Application No. PCT/EP2020/054445, filed Feb. 20, 2020 (pending), which claims the benefit of priority to German Patent Application No. DE 10 2019 104 502.9, filed Feb. 21, 2019, the disclosures of which are incorporated by reference herein in their entirety.

TECHNICAL FIELD

The invention relates to a combination machine for folding and die bending a workpiece, in particular sheet metal. The invention also relates to the use of a folding machine as a press brake.

BACKGROUND

In the field of forming technology, the use of single machines in the form of folding machines or die bending machines is known. There are generally two different types of bending available to a user. These are, on the one hand, bending with rotating tool movement, known as folding, and, on the other hand, bending with straight tool movement, known as die bending.

Bending machines for folding (folding machines) are usually used for bending sheet metal. During the folding process, the sheet metal is clamped between a lower beam and an upper beam that can be advanced toward the lower beam and is bent to the desired angle by a bending beam that pivots upwards. During folding, depending on the progress of the bending process, forces (bending forces) occur transversely/obliquely with respect to the advancing direction of the upper beam, substantially toward the rear of the folding machine. For this reason, conventional folding machines have a beveled or wedge-shaped upper beam or upper beam receptacle extending toward the rear of the folding machine.

In the case of die bending machines also die bending press, press brake or folding press), the material is formed by a bending punch that is guided vertically from above and is arranged on a movable press beam. The flat workpiece lies on a stationary die (also swaging die or bending die) arranged underneath it, with a, for example, V-shaped opening into which the bending punch is introduced during the bending process. By lowering of the bending punch, the sheet metal is pressed into the die and, depending on the insertion depth of the bending punch, can take on the shape of the die. The sheet metal thus bends at the desired angle, depending on the insertion depth of the bending punch and the shape of the tool. For die bending, there are basically two processing variants, free bending (also air bending, air edging, partial edging or edging on the base) and embossing bending. During free bending, the bending punch only moves so far into the die that there is still air between the material and the tool (die) after the desired angle has been obtained on the sheet metal. Alternatively, during free bending, the material can be substantially pressed onto the base of the die (edging onto the base), but without the material being embossed. During free bending, the material is pressed into the die with a relatively low pressure (low bending or pressing force). During embossing bending (embossing) the bending punch presses the sheet substantially completely to the base of the die, whereby the material is (plastically) deformed ("embossed") under high pressure (high bending or pressing force) between the bending punch and the die. The pressure required here is significantly higher than during free bending onto the base, for example about 2 to 7 times higher than during free bending onto the base. During die bending, therefore, depending on the progress of the bending process, high forces (bending/pressing forces) occur in the perpendicular/vertical direction, i.e. in the advancing direction of the bending punch. Known die bending machines therefore have a movable press beam which is arranged perpendicularly/vertically above the bending punch and is mounted on the machine frame so as to be adjustable in the vertical pressing direction (advancing direction of the bending punch). For actuation of the movable press beam, hydraulic cylinders are usually arranged in the perpendicular/vertical direction above the press beam. In contrast to the folding machine, the die bending machine with its press beam applies the pressure or the bending/pressing force, but has no shaping function itself, as compared to the bending beam of the folding machine. In the case of die bending machines, the bending angle is therefore only generated by the tools (bending punch and bending die).

So far, single machines in the form of folding machines or die bending machines have been used in the development of sheet metal parts, such as springs, contacts or casing parts. Depending on the workpiece, one or more folding processes or one or more die bending processes are necessary to obtain a finished sheet metal part. For the design of a workpiece, the limited possibilities of the relevant bending process often have to be taken into account. The design of the workpiece thus defines the respective bending process, whether folding or die bending. The known methods and known devices have so far only existed in single machines and are limited in the geometries to be generated. Furthermore, the folding method and the die bending method have different shaping options. Both bending methods (folding or die bending) therefore have individual advantages with regard to the type of metal parts to be bent and the bending requirements of a workpiece. Depending on the application or the shape of the workpiece to be produced, a choice must therefore be made between the folding method and the die bending method. Often a component manufacturer only has die bending machines or folding machines at its disposal. The component manufacturer's freedom of design is therefore very limited.

It is therefore desirable to combine the advantages of both bending methods (folding and die bending) in a single machine in order to provide as broad a spectrum of bending options as possible in a single machine, to increase flexibility and to significantly minimize costs.

SUMMARY

It is therefore an object of the present invention to provide a combination machine for folding and die bending of a workpiece which optimally combines both bending methods in a single machine and reduces or eliminates the disadvantages associated with the prior art. It is also an object of the present invention to increase flexibility and profitability. Furthermore, a high quality of the finished workpiece should be guaranteed.

According to a first aspect, a combination machine for folding and die bending of a workpiece, in particular sheet metal, is provided. The combination machine comprises: a lower tool holder which is designed to releasably receive at least one lower bending tool; an upper tool holder which is designed to releasably receive at least one upper bending tool and which can be advanced in a straight line in an advancing direction toward the lower tool holder; a pivotable tool holder which is designed to releasably receive at least one bending tool which is to be pivoted and which can be pivoted relative to the lower tool holder about a pivot axis running perpendicular to the advancing direction of the upper tool holder; and a machine body on which the upper tool holder is arranged, the machine body being designed to absorb the bending forces occurring in the advancing direction of the upper tool holder and the bending forces occurring during a pivoting process of the pivotable tool holder depending on the progress of the bending process.

A core idea in accordance with the principles of the present disclosure is to transfer the considerable forces occurring during folding and die bending in different directions to a machine body (e.g. existing within the combination machine) which is compact and is optimally designed for force absorption in order to achieve the necessary flexural rigidity of the combination machine and optimal force absorption, both during a die bending process and during a folding process. In this way, the two bending processes (folding and die bending) can be optimally combined in a single machine. Due to the optimal force transmission and force absorption, a high quality of the finished workpiece is also guaranteed.

According to a variant, the advancing direction of the upper tool holder is in the vertical direction. Additionally or alternatively, the advancing direction can be perpendicular to a workpiece support plane and/or to the lower tool holder. The workpiece support plane can be defined by the lower bending tool. In one embodiment, the support surface of the lower bending tool facing the upper tool holder or the upper bending tool forms the workpiece support plane.

Bending force can be understood to be a force that occurs during a folding process or a die bending process. This bending force can change or remain constant depending on the progress of the particular bending process. The bending force can be a folding force, pressing force or embossing force that occurs or is generated during a folding process or die bending process. In principle, a bending force can be understood as a force that occurs as a result of the movement of the upper tool holder and/or the pivotable tool holder. The force can also be a holding force that occurs when a workpiece is clamped between an upper bending tool and a lower bending tool.

According to a variant, the machine body can be designed to absorb the bending and/or pressing forces occurring during a folding process and the bending and/or pressing forces occurring during a die bending process. The machine body can also be designed to absorb the bending and/or pressing forces over the entire folding process or die bending process. The machine body can be designed to absorb forces (e.g. bending and/or pressing forces) substantially parallel to the advancing direction of the upper tool holder and/or forces (e.g. bending and/or pressing forces) substantially transversely/obliquely with respect to the advancing direction of the upper tool holder.

The combination machine can have a first drive device that can be coupled or is coupled to the upper tool holder to transmit a force (e.g. bending force, pressing force, embossing force, holding force, clamping force), wherein the upper tool holder is designed to exert a substantially perpendicular force in the advancing direction of the upper tool holder (e.g. bending force, pressing force, embossing force, holding force, clamping force) on the workpiece. The upper tool holder can therefore exert a force on the workpiece in a substantially perpendicular and/or vertical direction. The direction of the force can always remain substantially the same during the bending process. The strength of the force can, however, depend on the bending progress or the travel path and/or the penetration depth of a bending punch.

The first drive device can have at least one electric motor (for example a servomotor or stepper motor), a pneumatic unit and/or a hydraulic unit for raising and lowering the upper tool holder. The pneumatic unit can be operated with air or compressed air, for example. The hydraulic unit can be operated with water or oil, for example. The pneumatic unit and/or the hydraulic unit can be designed as a cylinder-piston arrangement which is acted upon by the medium in question (compressed air, water, oil, etc.). Alternatively or additionally, the first drive device can have a stepper motor, servomotor, spindle drive, eccentric or a gear. In one embodiment, the first drive device can have two electric motors. Alternatively, the first drive device can have two pneumatic or hydraulic units. According to a variant, a first drive device, e.g. an electric motor, a pneumatic unit or a hydraulic unit, can be arranged on each side of the upper tool holder (e.g. left and right of the upper tool holder) or centrally relative to the upper tool holder (e.g. at the middle of the upper tool holder). The first drive device can have an adjustable pull or push rod or linkage. The upper tool holder can thus be adjusted depending on the progress of the bending process, either continuously or in successive, small steps.

The lower bending tool can be designed as a die. The upper bending tool can be designed as a bending punch that can penetrate into the die. Alternatively, the upper bending tool can be designed as a die and the lower bending tool can be designed as a bending punch that can penetrate into the die. The die can be releasably and/or replaceably arranged on the lower tool holder (alternatively on the upper tool holder) and/or the bending punch can be arranged releasably and/or replaceably on the upper tool holder (alternatively on the lower tool holder). The die can be designed as a bending die. Furthermore, the die can have a V-shaped or U-shaped or semicircular recess into which the bending punch can penetrate. The bending punch can have a shape that is complementary to the die or to the V-shaped or U-shaped or semicircular recess of the die.

The combination machine can have a second drive device that can be coupled or is coupled to the pivotable tool holder for the transmission of a force (e.g. bending force, pressing force, edging force), wherein the pivotable tool holder is pivotable about the pivot axis relative to the lower tool holder by the second drive device and is designed to exert a force (e.g. bending force, pressing force, edging force) on the workpiece depending on the progress of the folding process. The pivotable tool holder can therefore exert a force on the workpiece in a direction substantially transverse/oblique with respect to the advancing direction (i.e. at an angle to the advancing direction) of the upper tool holder. The direction and/or the strength of the force can change depending on the progress of the bending process. The direction and/or strength of the force can therefore be dependent on the respective bending angle and/or pivot angle. The pivot angle is the angle that the pivotable tool holder covers during the pivoting process. The angular range can be between 0 degrees and 180 degrees, for example between 0 degrees and 170 degrees, preferably between 0 degrees and 155 degrees.

The second drive device can have at least one electric motor (for example a servomotor or stepper motor), a pneumatic unit or a hydraulic unit for pivoting the pivotable tool holder. The pneumatic unit can be operated with air or compressed air, for example. The hydraulic unit can be operated with water or oil, for example. The pneumatic unit and/or the hydraulic unit can be designed as a cylinder-piston arrangement which is acted upon by the medium in question (compressed air, water, oil, etc.). Alternatively or additionally, the second drive device can have a stepper motor, servomotor, spindle drive, eccentric or a gear. In one embodiment, the second drive device can have two electric motors. Alternatively, the second drive device can have two pneumatic or hydraulic units. According to a variant, a second drive device, e.g. an electric motor, a pneumatic unit or a hydraulic unit, can be arranged on each side of the pivotable tool holder (e.g. left and right of the pivotable tool holder) or centrally relative to the pivotable tool holder (e.g. at the middle of the pivotable tool holder). The second drive device can have an adjustable pull or push rod or linkage. The pivotable tool holder can thus be adjusted as a function of the progress of the bending process, either continuously or in successive, small steps.

In one embodiment, the lower tool holder can be designed as an immobile or stationary tool holder. In this embodiment, the lower tool holder cannot be moved relative to the upper tool holder or relative to the pivotable tool holder.

The pivotable tool holder can be designed to receive at least one pivotable bending tool in a releasable and/or replaceable manner. In a preferred embodiment, the lower tool holder is arranged below the upper tool holder.

The lower bending tool can be designed as a lower beam tool. The upper bending tool can be designed as an upper beam tool which can be advanced in the advancing direction up to a gap S equal to the thickness of the workpiece. The bending tool which is to be pivoted or is pivotable can be designed as a bending beam tool. The lower beam tool can be releasably and/or replaceably arranged on the lower tool holder. The upper beam tool can be releasably and/or replaceably arranged on the upper tool holder. The bending beam tool can be releasably and/or replaceably arranged on the pivotable tool holder. The upper beam tool can be designed to be complementary to the lower beam tool. According to one option, a surface (for example a workpiece contact surface) of the upper beam tool can be formed parallel to a surface (for example a workpiece contact surface or workpiece support plane) of the lower beam tool. A sheet metal part can thus be optimally clamped between the upper beam tool and the lower beam tool.

In one embodiment, when the lower beam tool is stationary, the bending beam tool can be adjusted in a workpiece support plane at right angles to a bending edge of the upper beam tool in a direction away from the lower beam tool by a distance depending on the progress of a folding process. The bending edge of the upper beam tool can have a defined and/or predetermined radius. This radius can be selected depending on the bending radius and/or workpiece. The pivot axis of the pivotable tool holder or the bending beam tool can be parallel to the bending edge of the upper beam tool. The pivot axis can also lie in the workpiece support plane. In a further variant, the lower beam tool can be arranged set back with its front edge facing the bending beam tool with respect to the bending edge of the upper beam tool. Additionally or alternatively, the front edge of the lower beam tool facing the bending beam tool can be arranged below (for example vertically below) the bending edge of the upper beam tool.

The lower tool holder and the pivotable tool holder can be arranged on a slide which can be moved relative to the upper tool holder. The combination machine can have a slide drive (for example an electric motor, stepper motor, servomotor, eccentric or a spindle drive) for moving the slide. In one embodiment, the lower beam tool can be adjustable together with the bending beam tool in the workpiece support plane at right angles to the bending edge of the upper beam tool, for example by the particular sheet metal thickness. The combination machine can be designed so that before a folding process begins, the lower beam tool is moved together with the bending beam tool in the workpiece support plane at right angles to the bending edge of the upper beam tool, for example by the particular sheet metal thickness.

The combination machine can also have a stop unit that is arranged between the upper tool holder or the upper bending tool (e.g. upper beam tool) and the lower tool holder or the lower bending tool (e.g. lower beam tool) and is adjustable via a drive. The stop unit or parts thereof can be designed to be replaceable. The stop unit can be displaced by the drive in the horizontal direction, that is to say substantially perpendicular to the advancing direction of the upper tool holder, and/or in the vertical direction, that is to say substantially parallel to the advancing direction of the upper tool holder.

The machine body of the combination machine is held or can be secured on two lateral uprights of a machine frame. According to a variant, the machine body is arranged inside the combination machine. In one embodiment, the machine body is arranged centrally inside the combination machine. The machine body can be arranged centrally or in the middle between the two lateral uprights of the machine frame. The side uprights of the machine frame can be designed as side panels. The two lateral uprights or side panels of the machine frame can extend substantially in the vertical direction. In a variant, the two lateral uprights can be arranged parallel to one another.

The machine body can have a substantially trapezoidal or diamond-shaped cross section. The trapezoidal cross-section can be designed as a right-angled trapezoid or an isosceles trapezoid. In one embodiment, the machine body can have at least one side face/side element which is arranged parallel to the advancing direction of the upper tool holder and/or the upper bending tool. The machine body can have at least one side face/side element which is perpendicular on top of the upper tool holder. According to an advantageous variant, the machine body can have at least one side face/side element which is arranged parallel to the advancing direction of the upper tool holder and is perpendicular on top of the upper tool holder. The side faces/side elements of the machine body can be designed as plates, for example metal plates. The upper tool holder can form part of the machine body and/or a side face/side element of the machine body. This part or this side face/side element is designed to absorb forces running substantially horizontally. Furthermore, this part or this side face/side element contributes to the stability of the machine body. Furthermore, this part or this side face/side element can be formed at least in sections perpendicular to the advancing direction of the upper tool holder and/or perpendicular to the side face/side element of the machine body that is perpendicular to the upper tool holder. Alternatively or additionally, this part or this side face/side element can be formed, at least in sections, parallel to an opposite side face/side element of the machine body.

The machine body can define a parallelogram of forces in cross section. The forces acting at one (for example the same) point of the parallelogram of forces and/or the total force of the parallelogram of forces can be the aforementioned bending or pressing forces during a bending process. The machine body can therefore be designed to absorb the two forces acting at one (for example the same) point of the parallelogram of forces and/or the total force. The total force of the parallelogram of forces can result from the two forces acting at one point. For example, the total force can result from a folding force occurring during a folding process and/or from a pressing force occurring during a die bending process. At least one side of the parallelogram of forces can run parallel to a side face/side element of the machine body. In a preferred embodiment, one, two and/or three side faces/side elements of the machine body each define a side length of the parallelogram of forces in cross section. According to a variant, two and/or three side lengths of the parallelogram of forces can each run parallel to a respective side face/side element of the machine body in cross section.

The side face/side element of the machine body that is perpendicular on top of the upper tool holder can be designed as a press beam. This side face/side element of the machine body can therefore have a greater width or thickness in cross section compared to the other side faces/side elements of the machine body.

The side faces/side elements of the machine body can be welded and/or screwed to one another. One or more side faces/side elements of the machine body can be welded and/or screwed to the upper tool holder.

The tool holders (lower tool holder, upper tool holder and pivotable tool holder) of the combination machine can each have at least one clamping means for releasably fixing and/or replacing the particular bending tool. The clamping means can be designed as a quick-release clamping system. With the respective clamping means, the lower bending tool, the upper bending tool and/or the bending tool which is to be pivoted or is pivotable can be released from the relevant tool holder or fastened to the respective tool holder. The clamping means can have a clamping jaw (or gripping jaw) by means of which the respective bending tool can be releasably secured by clamping. The clamping jaw can be attached or fixed to the respective tool holder by means of a screw connection. The lower tool holder, the upper tool holder and/or the pivotable tool holder can contain a plurality of (e.g. two, three, four, etc.) clamping means. In a preferred variant, each of the tool holders can have ten clamping means. One or more bending tools can therefore be arranged in a releasable and/or replaceable manner on the relevant tool holder. The plurality of bending tools can be arranged directly next to one another or at a distance from one another on the respective tool holder. For example, one or more bending punches and/or one or more upper beam tools can be arranged on the upper tool holder. One or more dies and/or one or more lower beam tools can be arranged on the lower tool holder. One or more bending beam tools can be arranged on the pivotable tool holder. The respective tool holders can therefore also be equipped with standard tool sets.

The combination machine can have at least one first adapter piece which is designed to releasably and/or replaceably fix a lower bending tool, in particular a die (or a lower beam), to the lower tool holder. Additionally or alternatively, the combination machine can have at least one second adapter piece which is designed to releasably and/or replaceably fix an upper bending tool, in particular a bending punch (or an upper beam), to the upper tool holder.

At least a part of the first adapter piece can be designed to be complementary to at least one part of the lower tool holder so that a releasable connection (e.g. a clamp connection or by inserting the adapter piece into the lower tool holder) can be established between the first adapter piece and the lower tool holder. At least part of the second adapter piece can be designed to be complementary to at least one part of the upper tool holder, in such a way that a releasable clamp connection can be established between the second adapter piece and the upper tool holder.

The first adapter piece can have a clamping means for releasably fixing or securing the lower bending tool. The second adapter piece can have a clamping means for releasably fixing or securing the upper bending tool. The respective clamping means can have a clamping jaw. The clamping jaw can be fixed by means of a screw connection.

The combination machine can be designed, in particular, for metal forming. For example, it can bend sheet metal, wires, pipes or other metal parts.

According to a second aspect, a use of a folding machine as a press brake is described, wherein the folding machine comprises: a lower tool holder which is designed to releasably receive at least one lower bending tool; an upper tool holder which is designed to releasably receive at least one upper bending tool and which can be advanced in a straight line in an advancing direction toward the lower tool holder; and a pivotable tool holder which is designed to releasably receive at least one bending tool which is to be pivoted and is pivotable relative to the lower tool holder about a pivot axis running perpendicular to the advancing direction of the upper tool holder.

According to a variant, a lower bending tool designed as a die can be releasably arranged on the lower tool holder. Additionally or alternatively, an upper bending tool designed as a bending punch that can penetrate into the die can be releasably arranged on the upper tool holder. In a variant, the upper beam tool can be used as a bending punch.

BRIEF DESCRIPTIONS OF THE DRAWINGS

Further aspects, features and advantages of the combination machine disclosed here for folding and die bending of a workpiece are apparent from the embodiments explained below and from the figures.

Figure 1:
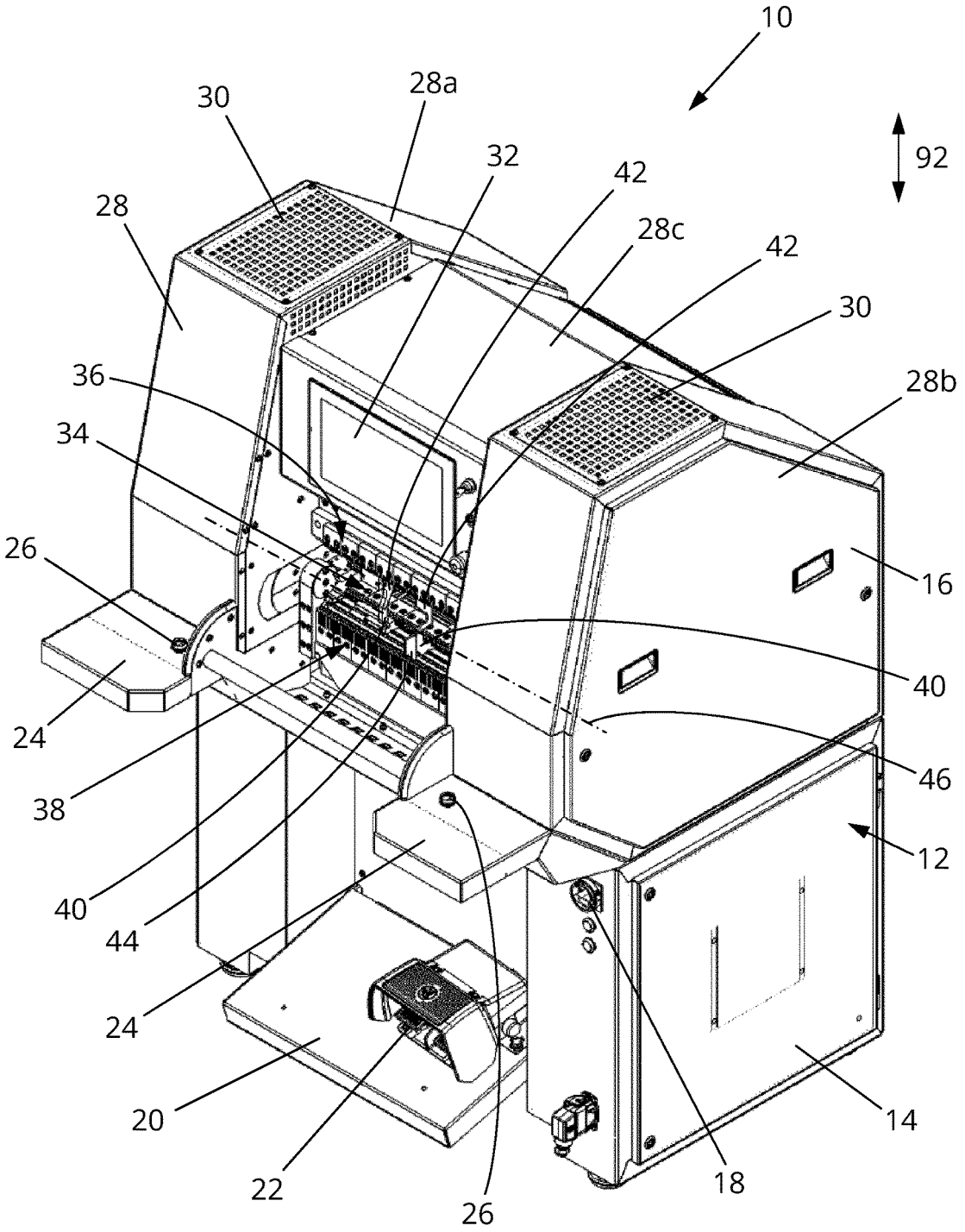
FIG. 1 is a perspective view of an embodiment of a combination machine for folding and die bending a workpiece.
Figure 2:
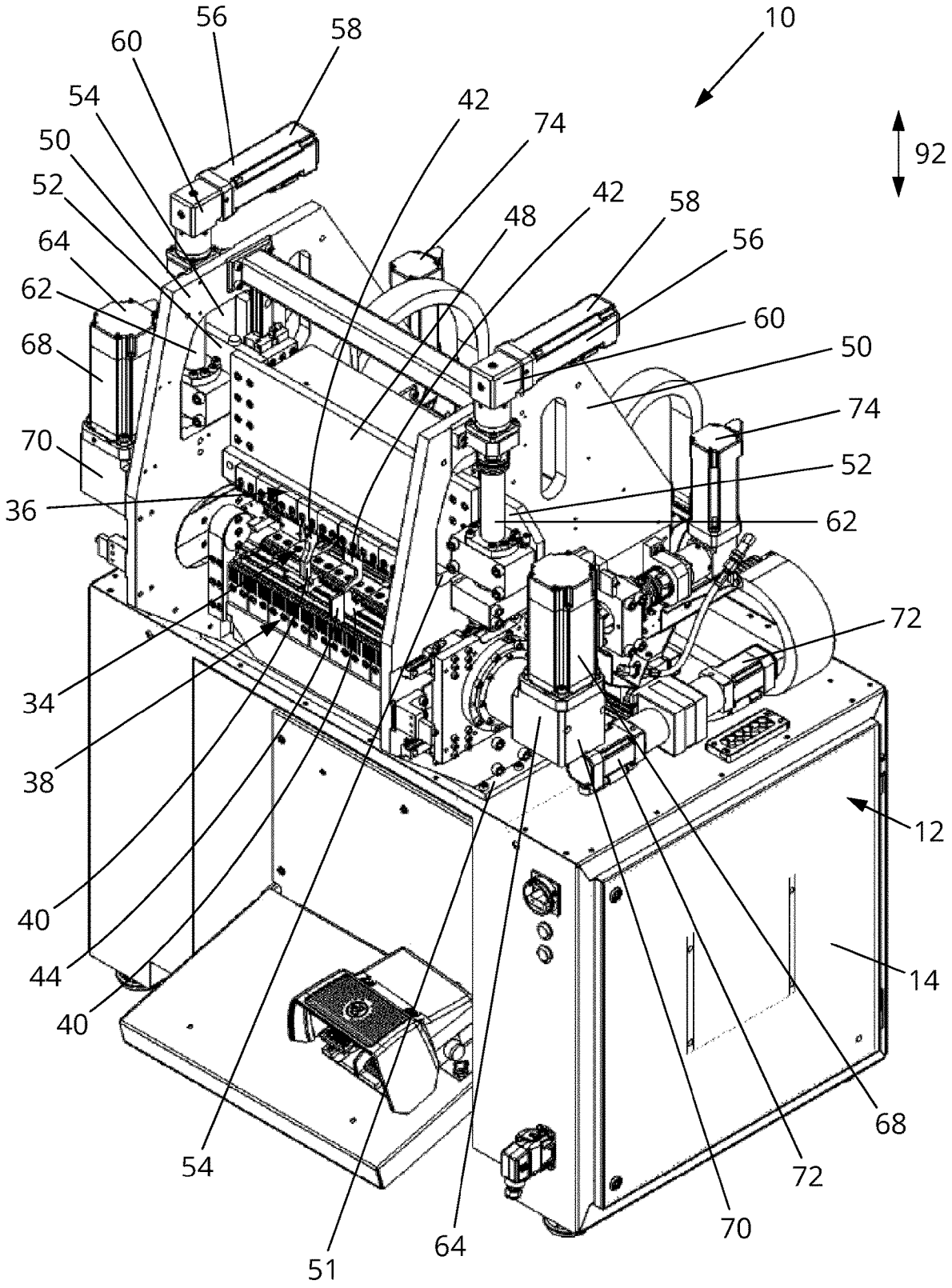
FIG. 2 is a perspective view of the combination machine according to FIG. 1 without an upper casing part.
Figure 6A:
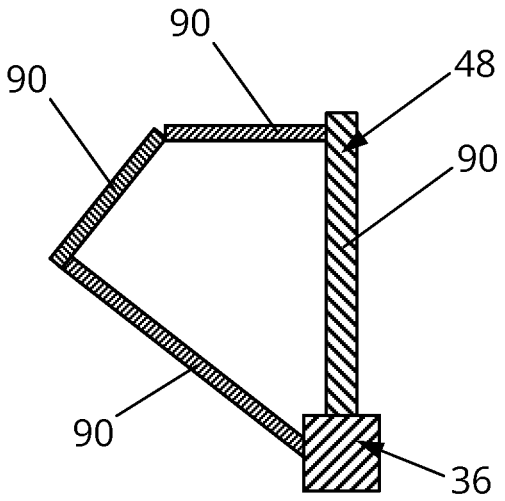
Figure 6B:
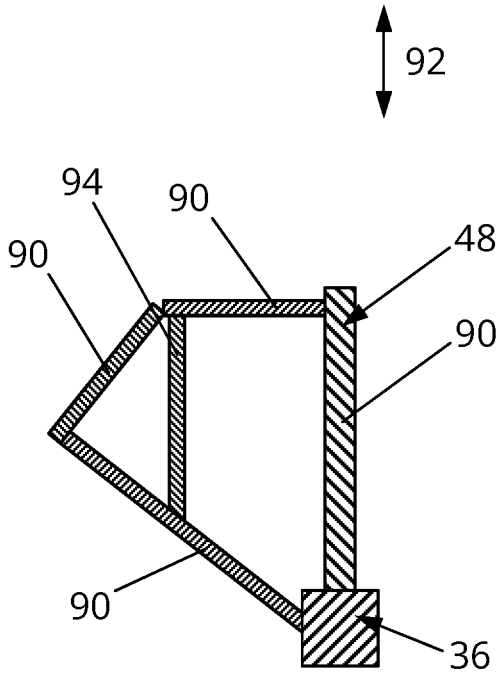
Figure 6C:
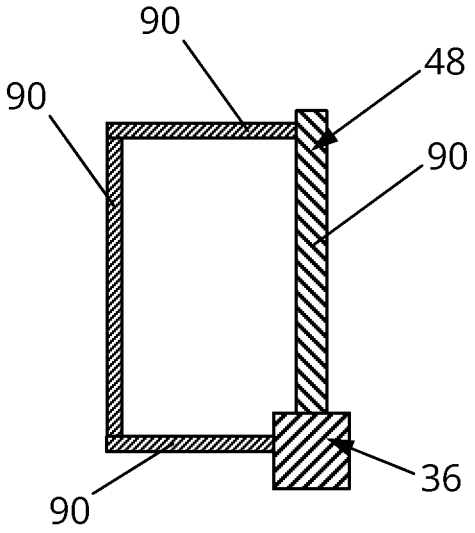
Figure 6D:
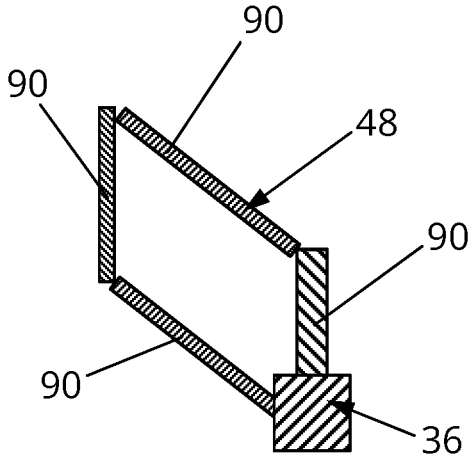
Figure 6E:
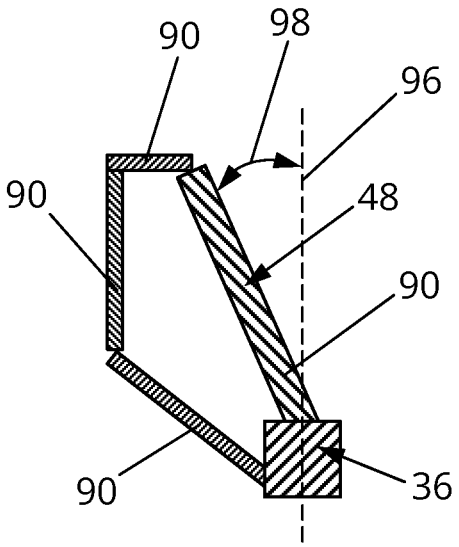
Figure 6F:
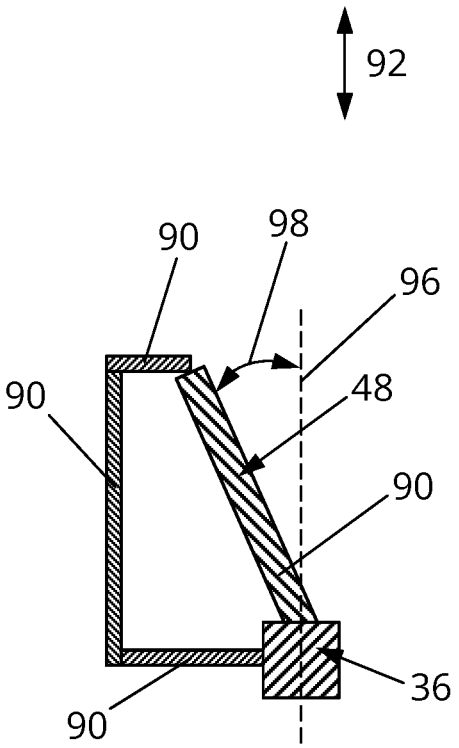
Figure 6G:
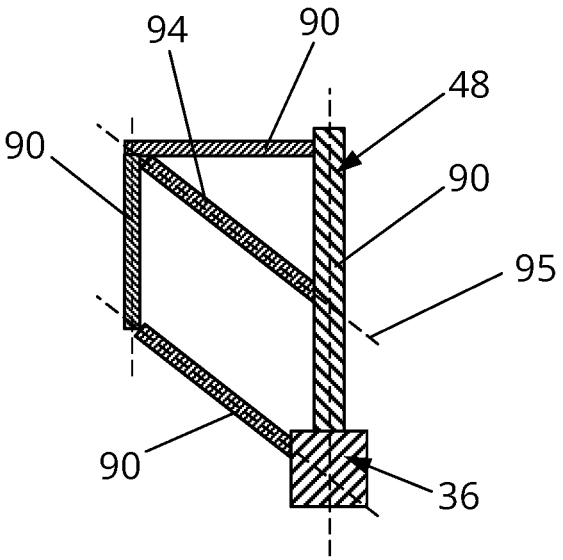
Figure 7:
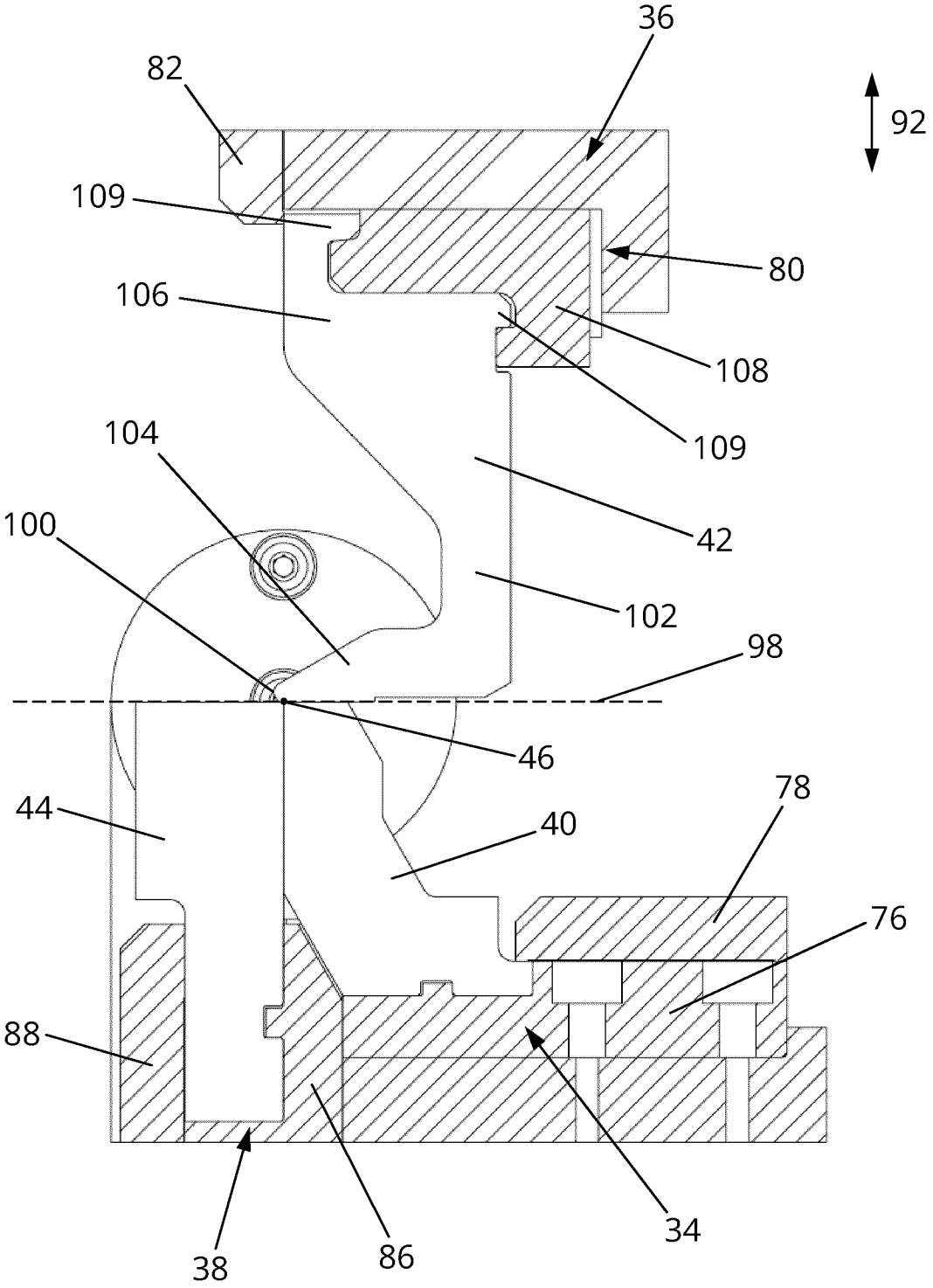
Figure 8:
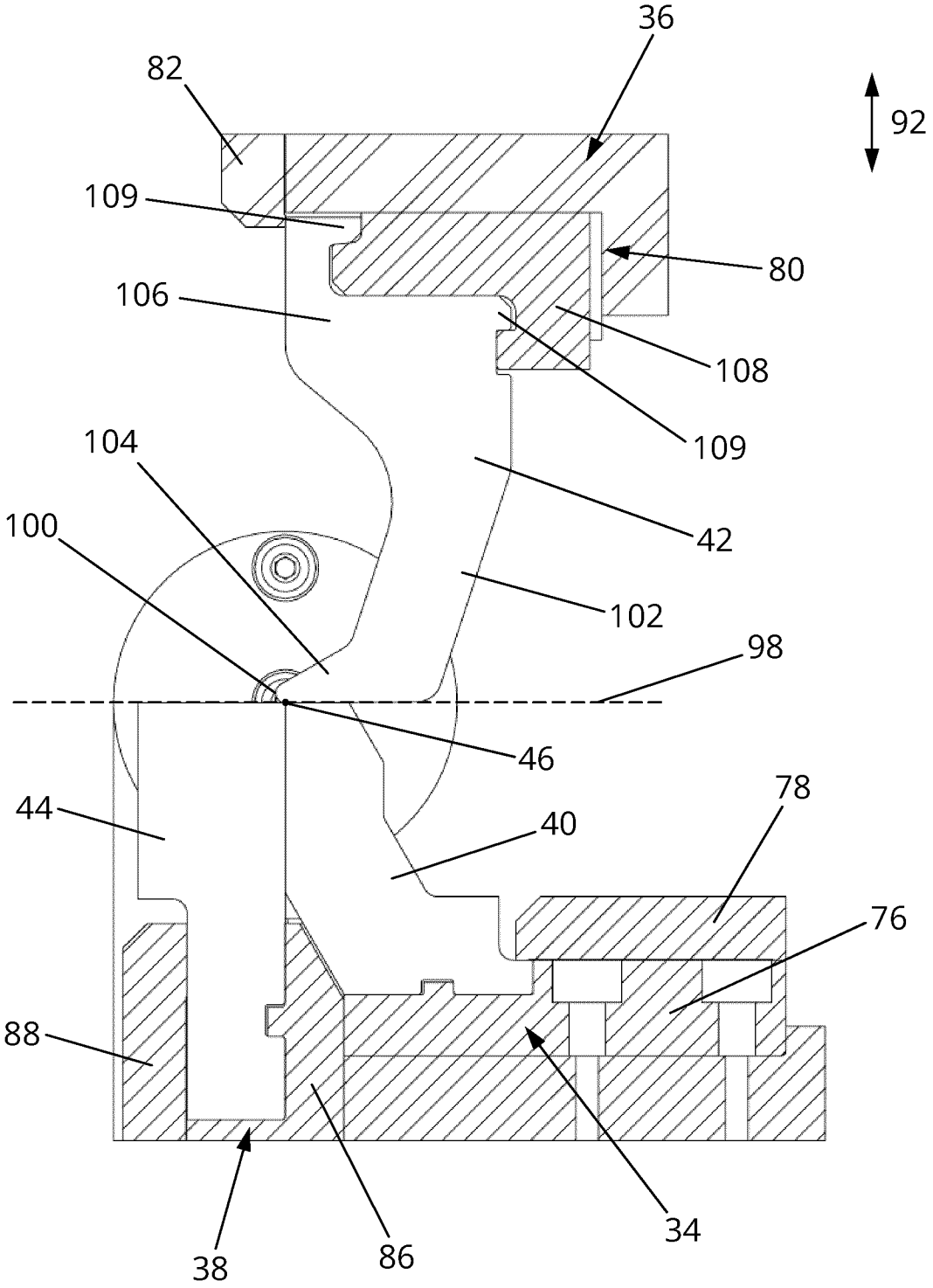
Figure 9:
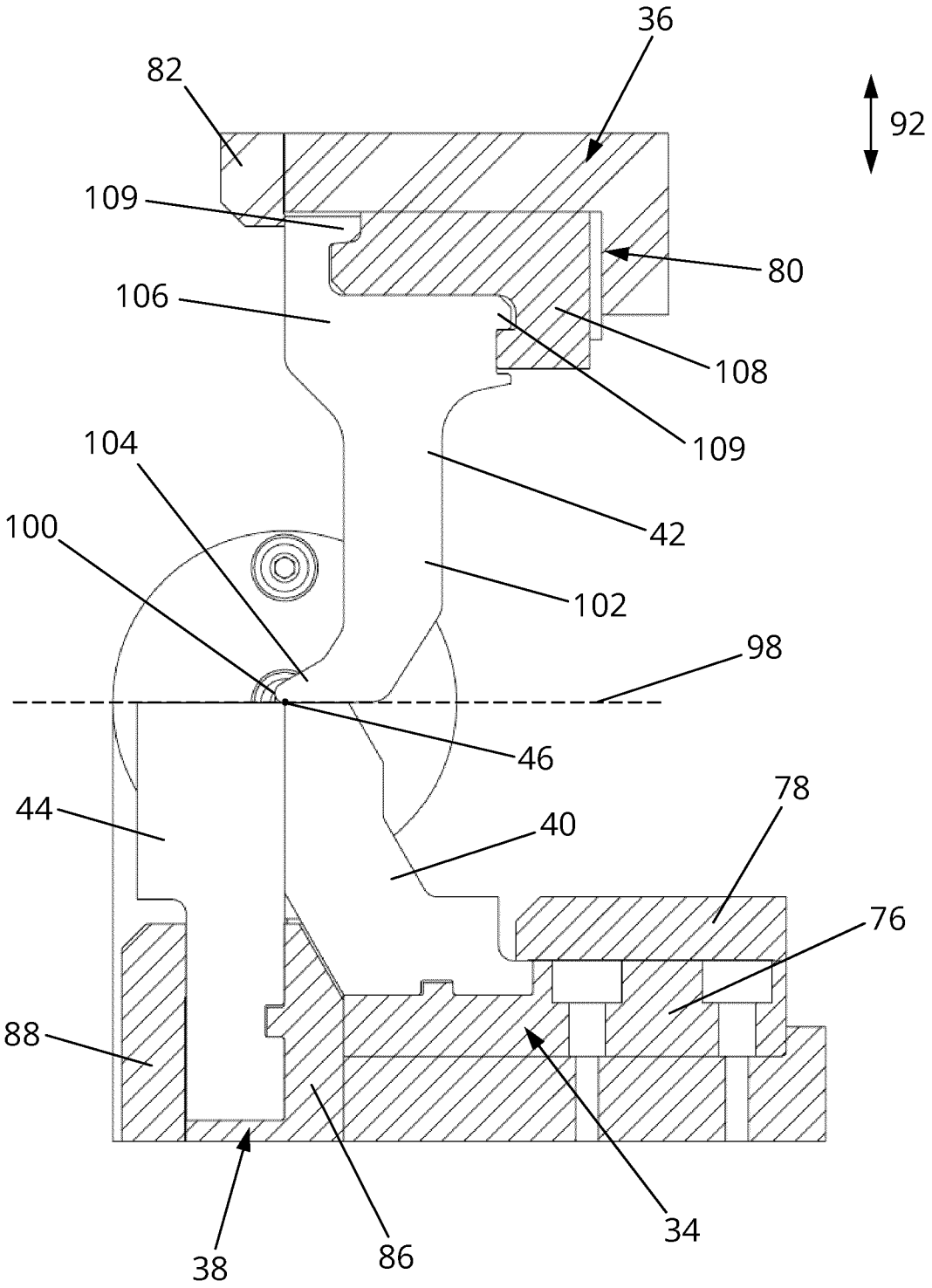
Figure 10:
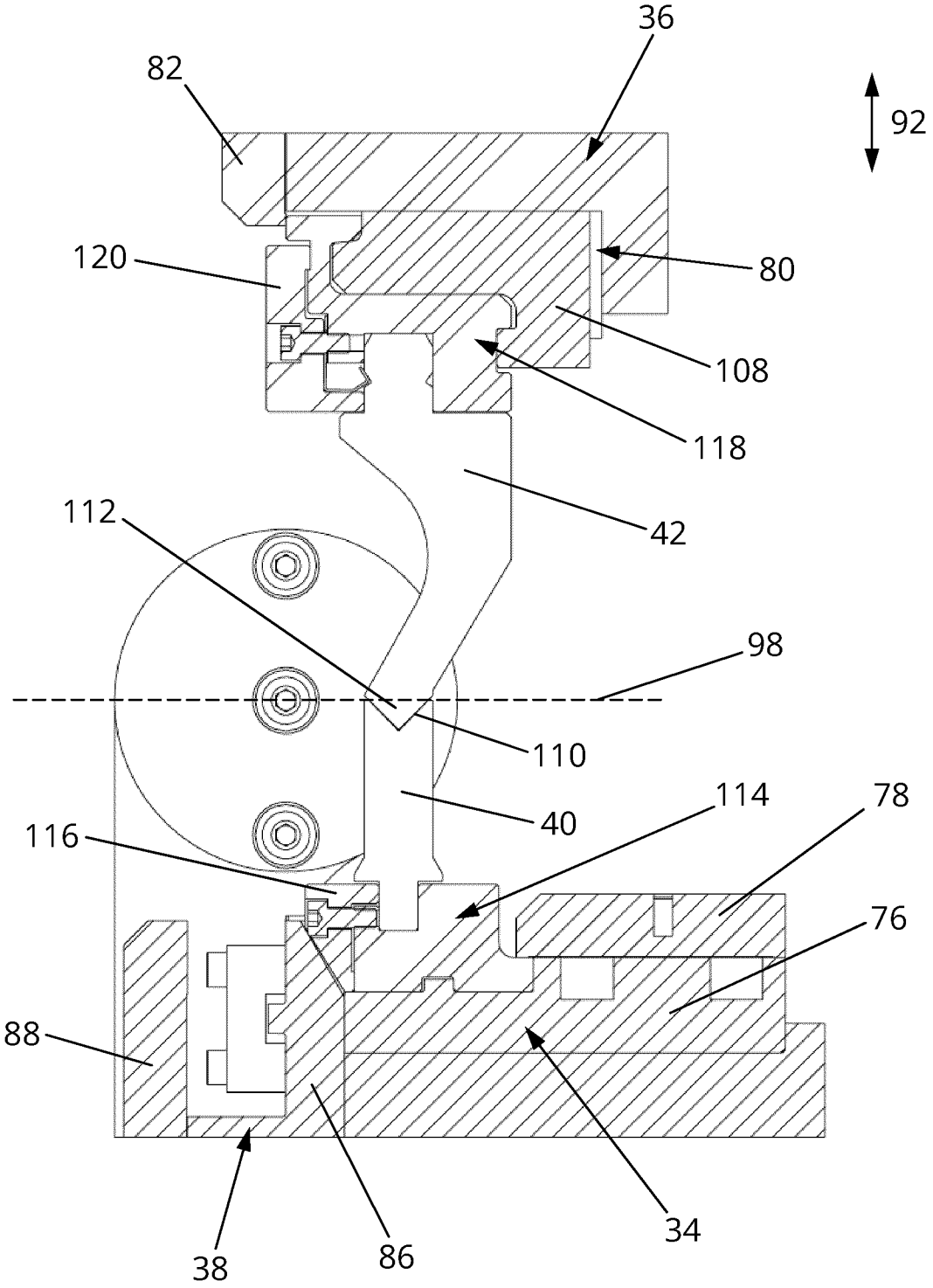

FIG. 6*a* is a schematic cross sectional view of a variant of the machine body;

FIG. 6*b* is a schematic cross sectional view of a further variant of the machine body;

FIG. 6*c* is a schematic cross sectional view of a further variant of the machine body;

FIG. 6*d* is a schematic cross sectional view of a further variant of the machine body;

FIG. 6*e* is a schematic cross sectional view of a further variant of the machine body;

FIG. 6*f* is a schematic cross sectional view of a further variant of the machine body;

FIG. 6*g* is a schematic cross sectional view of a further variant of the machine body;

FIG. 7 is a sectional view of a variant of bending tools arranged in the tool holders of the combination machine according to FIGS. 1 and 2;

FIG. 8 is a sectional view of a further variant of bending tools arranged in the tool holders of the combination machine according to FIGS. 1 and 2;

FIG. 9 is a sectional view of a further variant of bending tools arranged in the tool holders of the combination machine according to FIGS. 1 and 2; and FIG. 10 is a sectional view of a further variant of bending tools arranged in the tool holders of the combination machine according to FIGS. 1 and 2.

DETAILED DESCRIPTION

In the following, embodiments of a combination machine for folding and die bending of a workpiece are explained by way of example. Corresponding or comparable elements are provided with the same reference signs.

FIGS. 1 to 5 show an embodiment of a combination machine 10 for folding and die bending a workpiece. Firstly, the combination machine 10 is explained in more detail with reference to FIGS. 1 and 2.

FIG. 1 shows a perspective external representation of the combination machine 10. The combination machine 10 has a machine frame 12 with a lower part 14 and an upper part 16 arranged above the lower part. A main switch 18 is attached to the lower part 14 of the machine frame 12 in order to switch the combination machine 10 on and off. The main switch 18 is entirely designed as a rotary switch. A foot rest 20 is provided in the lower area of the lower part 14. A foot pedal 22 is arranged on the foot rest 20. A movement of a tool holder and/or a bending tool can be triggered by pressing the foot pedal 22. Alternatively, a plurality of (for example two or three) foot pedals can be provided in order to actuate a specific tool holder and/or a specific bending tool in each case. A hand rest 24 is arranged in each case on the left and right on the front face of the combination machine 10. While using the combination machine 10, a user can place his left hand on the left hand rest 24 and his right hand on the right hand rest 24. A pressure switch 26 is located on each hand rest 24. A movement of a tool holder (for example a pivotable tool holder) can be triggered by the pressure switches 26. For safety reasons, it can be provided that both pressure switches 26 must be actuated in order to actuate the tool holder.

The upper part 16 of the machine frame 12 has a removable casing 28. The casing 28 is designed in three parts in the present embodiment. The casing 28 has a left casing part 28*a*, a right casing part 28*b* and a middle casing part 28*c*. Ventilation holes or slots 30 are provided on the casing 28 or on the left casing part 28*a* and right casing part 28*b* in order to ensure adequate ventilation of the interior of the combination machine 10. The middle casing part 28*c* is arranged between the left casing part 28*a* and the right casing part 28*b*. A display device 32, for example a screen, for displaying machine data is attached to the middle casing part 28*c*. The display device 32 can be designed as a touch display (touch-sensitive screen). By means of the touch-sensitive display device 32, a user can program the combination machine 10 and/or can call up certain programs and thereby operate the combination machine 10. The programs can be stored in a machine control (not shown).

The combination machine 10 has a lower tool holder 34, an upper tool holder 36 and a pivotable tool holder 38. As can be seen in FIG. 1, the three tool holders 34, 36, 38 are arranged in the upper part 16 of the machine frame 12 between the left casing part 28*a* and the right casing part 28*b*. The lower tool holder 34 is designed to releasably receive at least one lower bending tool 40. The upper tool holder 36 is designed to releasably receive at least one upper bending tool 42. The upper tool holder 36 can be advanced in a straight line in an advancing direction 92 (from top to bottom in FIG. 1) toward the lower tool holder 34. The pivotable tool holder 38 is designed to releasably receive at least one bending tool 44 which is to be pivoted or is pivotable. The pivotable tool holder 38 can be pivoted relative to the lower tool holder 34 about a pivot axis 46 running perpendicular to the advancing direction 92 of the upper tool holder 36.

The combination machine 10 also has a machine body 48 which is arranged in the upper part 16 of the machine frame 12 (FIG. 2). The machine body 48 is located within the casing 28. In the present embodiment according to FIG. 1, the machine body 48 is arranged within the middle casing part 28*c*.

FIG. 2 now shows a perspective illustration of the combination machine 10 without the upper casing 28. The machine frame 12 has two lateral uprights 50. The side uprights 50 are designed as side panels and extend in the vertical direction (from top to bottom in FIG. 2). The side panels 50 are fastened to a horizontally arranged base plate 51 of the machine frame 12. The base plate 51 rests on the lower part 14 of the machine frame 12 and can be fastened thereto. One side panel 50 is located substantially on the left and the other side panel 50 is located substantially on the right side of the combination machine 10. The lower tool holder 34, the upper tool holder 36 and the pivotable tool holder 38 are arranged between the two side panels 50. The machine body 48 is also arranged between the two side panels 50. The upper tool holder 36 is arranged on the machine body 48 and fastened thereto. The machine body 48 is held on the side panels 50 and can be secured thereon. The machine body 48 has two holding plates 52. In each case a holding plate 52 is attached to the left and right side of the machine body 48, for example by means of screws. The holding plates 52 of the machine body 48 protrude through a recess 54 in the side panels 50. The holding plates 52 of the machine body 48 thus protrude on the side faces of the side panels 50 facing away from the machine body 48 and extend to the left and right side of the combination machine 10.

The combination machine 10 has a first drive device 56 that can be coupled or is coupled to the upper tool holder 36 for transmitting a force (depending on the application, for example a bending force, pressing force, embossing force, holding force or clamping force). The first drive device 56 has two electric motors 58 for raising and lowering the upper tool holder 36. The electric motors 58 of the first drive device 56 are each connected to a ball screw drive 62 via a gear 60 (for example an angular planetary gear). In the present embodiment according to FIG. 2, an electric motor 58, a gear 60 and a ball screw drive 62 of the first drive device 56 are arranged on each side of the upper tool holder 36 (here on the left and right of the upper tool holder 36). The first drive device 56 is correspondingly fastened to the side faces of the side panels 50 of the machine frame 12 facing away from the machine body 48. The ball screw drives 62 are fastened to the holding plates 52 of the machine body 48. The rotary movement generated by the electric motors 58 is converted into a linear movement by the ball screw drives 62. By movement of the ball screw drives 62, the holding plates 52 of the machine body 48 are moved within the recesses 54 of the side panels 50. This enables the holding plates 52 and thus the machine body 48 and the upper tool holder 36 to be lowered and raised. In the present embodiment, the holding plates 52 of the machine body 48 can be moved in the perpendicular or vertical direction by the ball screw drives 62 driven by the electric motors 58, i.e. in the advancing direction 92 (from top to bottom in FIG. 2). The upper tool holder 36 can thus exert a substantially perpendicular force on the workpiece in the advancing direction 92. As an alternative to the ball screw 62, a rail can be provided along which or within which the relevant holding plate 52 of the machine body 48 can be moved.

Furthermore, the combination machine 10 has a second drive device 64 that can be coupled or is coupled to the pivotable tool holder 38 for transmitting a force (for example a bending force or pressing force). The second drive device 64 has two electric motors 68 for pivoting the pivotable tool holder 38 about the pivot axis 46. The electric motors 68 of the second drive device 64 are each connected to the pivotable tool holder 38 via a gear 70. In the present embodiment according to FIG. 2, an electric motor 68 and a gear 70 of the second drive device 64 are arranged on each side of the pivotable tool holder 38 (in this case on the left and right of the pivotable tool holder 38). The second drive device 64 is located on the sides of the side panels 50 of the machine frame 12 facing away from the pivotable tool holder 38. The pivotable tool holder 38 can thus be adjusted or pivoted by means of the electric motors 68 of the second drive device 64, either continuously or in successive small steps, depending on the progress of the bending process. The pivotable tool holder 38 can therefore exert a force (e.g. a bending force) on the workpiece in a direction transversely/obliquely with respect to the advancing direction 92 (i.e. at an angle to the advancing direction 92) of the upper tool holder 36.

The combination machine 10 has a stop unit arranged between the upper tool holder 36 or the upper bending tool 42 and the lower tool holder 34 or the lower bending tool 40 (not shown in FIGS. 1 and 2). The stop unit can be designed as a linear stop. The stop unit can preferably have two or more stop towers, for example a left and a right stop tower. The stop unit can be adjusted or displaced by a drive in the horizontal direction, i.e. substantially within a plane perpendicular to the advancing direction 92 of the upper tool holder 36, and/or in the vertical direction, i.e. substantially parallel to the advancing direction 92 of the upper tool holder 36. In the present embodiment, the drive of the stop unit has at least one electric motor 72.

To move the pivotable tool holder 38 in a direction away from the lower tool holder 34 by a distance which depends on the progress of a bending process, the combination machine 10 has a further drive in the form of an electric motor 74. Two electric motors 74 can also be provided to advance the pivotable tool holder 38. In the present embodiment, the lower tool holder 34 is designed as an immobile or stationary tool holder.

Figure 3:
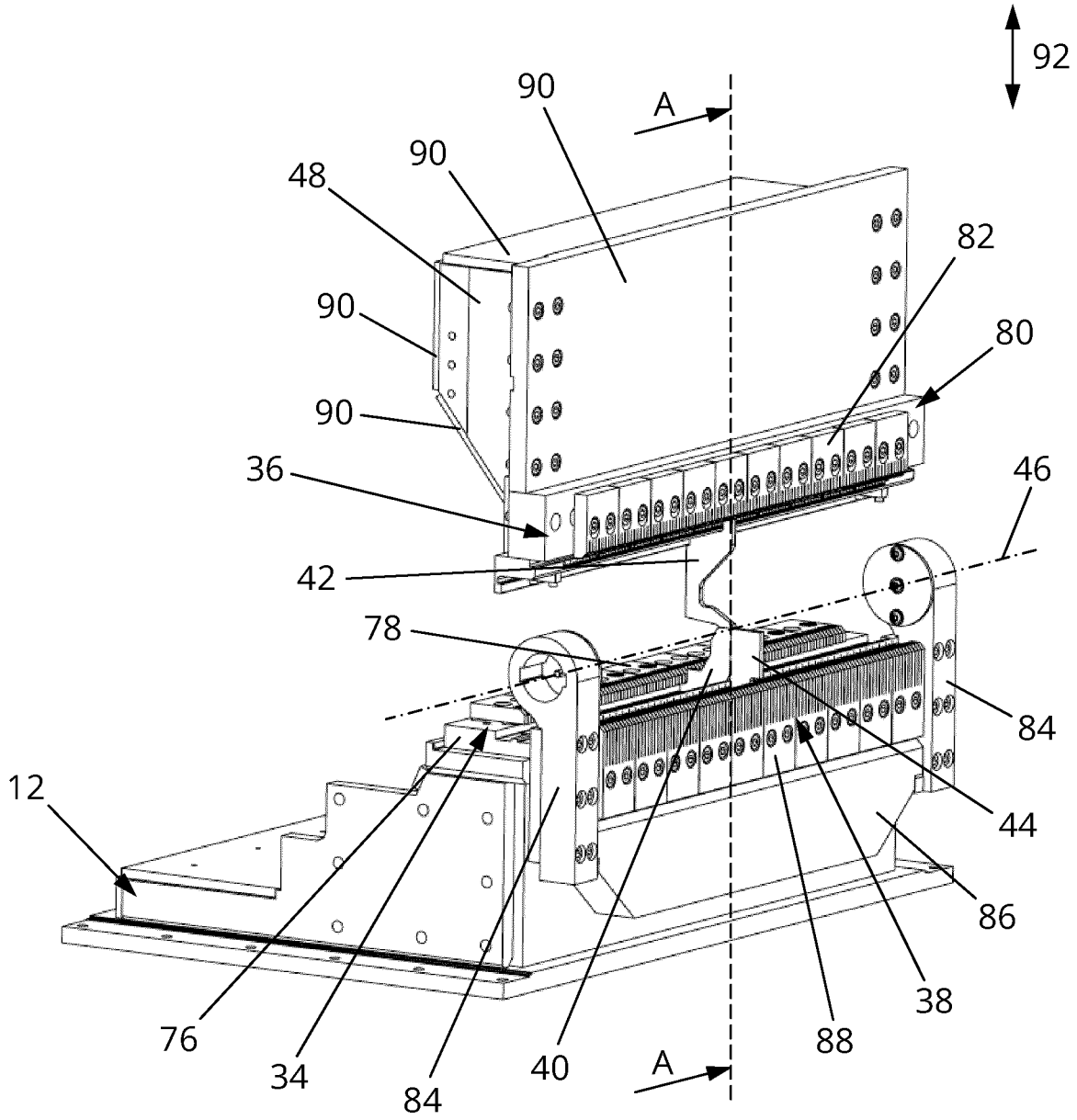
FIG. 3 is a perspective front view of an embodiment of the machine body and the tool holders of the combination machine according to FIGS. 1 and 2.
Figure 4:
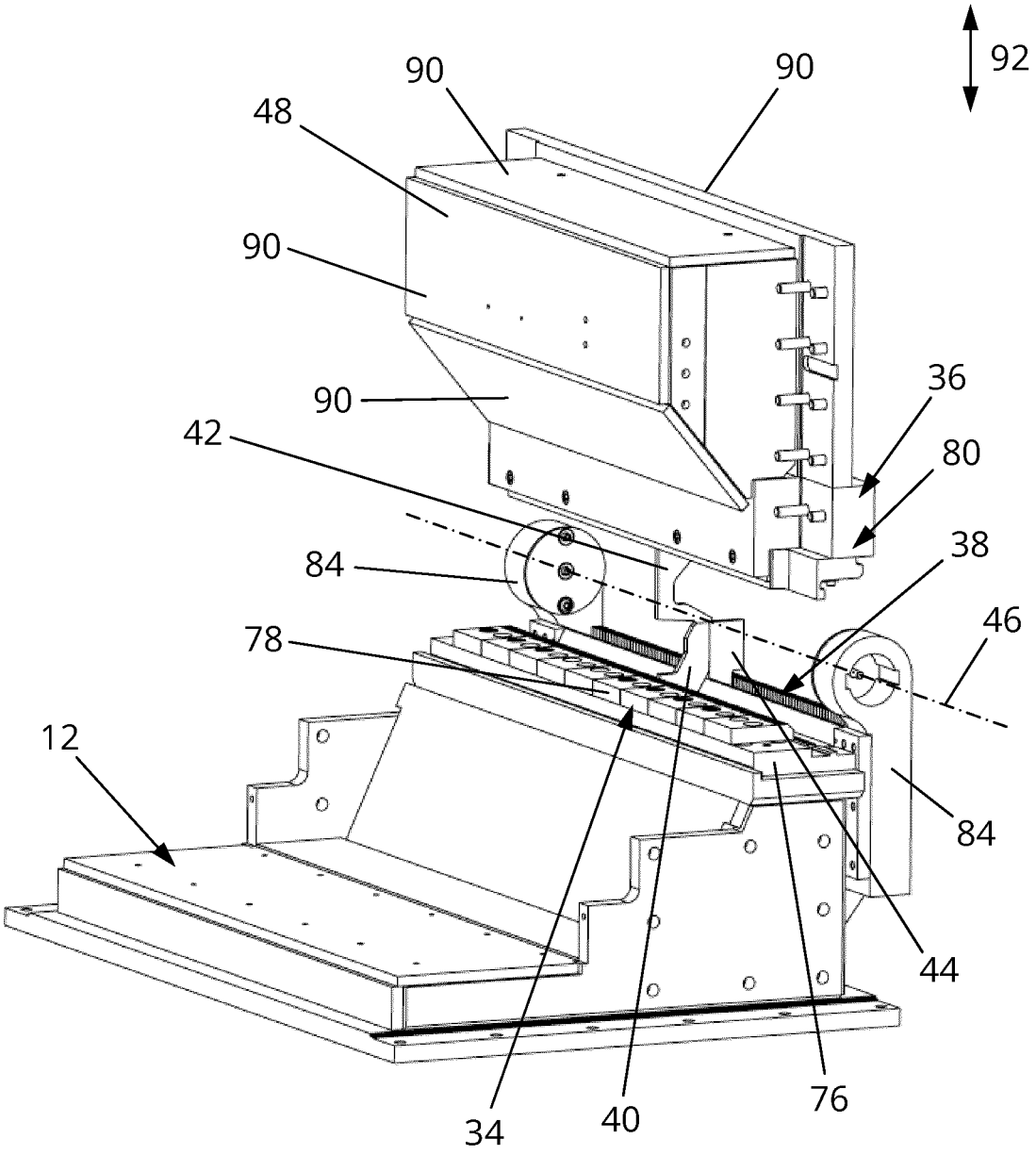
FIG. 4 is a perspective rear view of the machine body and the tool holders according to FIG. 3.

FIGS. 3 and 4 show a perspective front view (FIG. 3) and rear view (FIG. 4) of an embodiment of the machine body 48 and the tool holders 34, 36, 38 of the combination machine 10. As can be seen in FIGS. 3 and 4, the lower tool holder 34, the upper tool holder 36 and the pivotable tool holder 38 are aligned parallel to one another (along their longitudinal extensions).

The lower tool holder 34 is fastened to the machine frame 12 and has a holder rail 76. In the present embodiment, a plurality of (in this case 10) clamping means 78 designed as a quick-release clamping system are attached to the holder rail 76 of the lower tool holder 34, which are described in more detail in connection with FIG. 7 to 10. For the sake of clarity, only a single lower bending tool 40 is clamped into the lower tool holder 34 by means of a clamping means 78.

The upper tool holder 36 is fastened to the machine body 48 and has a holder rail 80. In the present embodiment, a plurality of clamping means 82 (in this case 10) designed as a quick-release clamping system are attached to the holder rail 80 of the upper tool holder 36, which are described in more detail in connection with FIGS. 7 to 10. For the sake of clarity, only a single upper bending tool 42 is clamped into the upper tool holder 36 by means of a clamping means 82. As shown in FIGS. 3 and 4, the upper bending tool 42 is arranged above the lower bending tool 40.

The pivotable tool holder 38 is arranged between two pivot levers 84 and fastened to them. The pivot levers 84 are mounted on the machine frame 12 so as to be rotatable about the pivot axis 46. The second drive device 64 is connected to the two pivot levers 84 and can pivot them. The pivotable tool holder 38 also has a holder rail 86, to which, in the present embodiment, a plurality of (in this case 10) clamping means 88 designed as a quick-release clamping system are attached. The clamping means 88 are described in more detail in connection with FIGS. 7 to 10. Here too, for the sake of clarity, only a single bending tool 44 to be pivoted is clamped into the pivotable tool holder 38 by means of a clamping means 88. As shown in FIGS. 3 and 4, the bending tool 44 to be pivoted is located below the upper bending tool 42 and in front of the lower bending tool 40.

The machine body 48 has a plurality of side faces or side elements 90 and is arranged substantially above the upper tool holder 36. The side faces or side elements 90 of the machine body 48 are designed as metal plates in the present embodiment. The machine body 48 can be designed as a hollow body. One or more support structures can be arranged within the machine body 48, and, for example, connect opposite side faces or side elements 90 of the machine body 48 to one another. Additionally or alternatively, one or more support structures can be provided which connect a part of the upper tool holder 36 to a side face/side element 90 of the machine body 48. The support structure can be designed as a support strut or piece plate. The support structure can connect one or more side faces/side elements 90 of the machine body 48 to one another. The side faces/side elements 90 of the machine body 48 are welded to one another in the present embodiment. According to the variant shown in FIGS. 3 and 4, two side faces/side elements 90 of the machine body 48 are welded to the upper tool holder 36.

The geometric configuration of the machine body 48 is designed so that the bending forces occurring in one direction of movement or in the advancing direction 92 of the upper tool holder 36 and the bending forces occurring during a pivoting process of the pivotable tool holder 38 depending on the progress of a bending process are absorbed by the machine body 48. The geometry of the machine body 48 is based on the following FIGS. 5 and 6 described in more detail.

Figure 5:
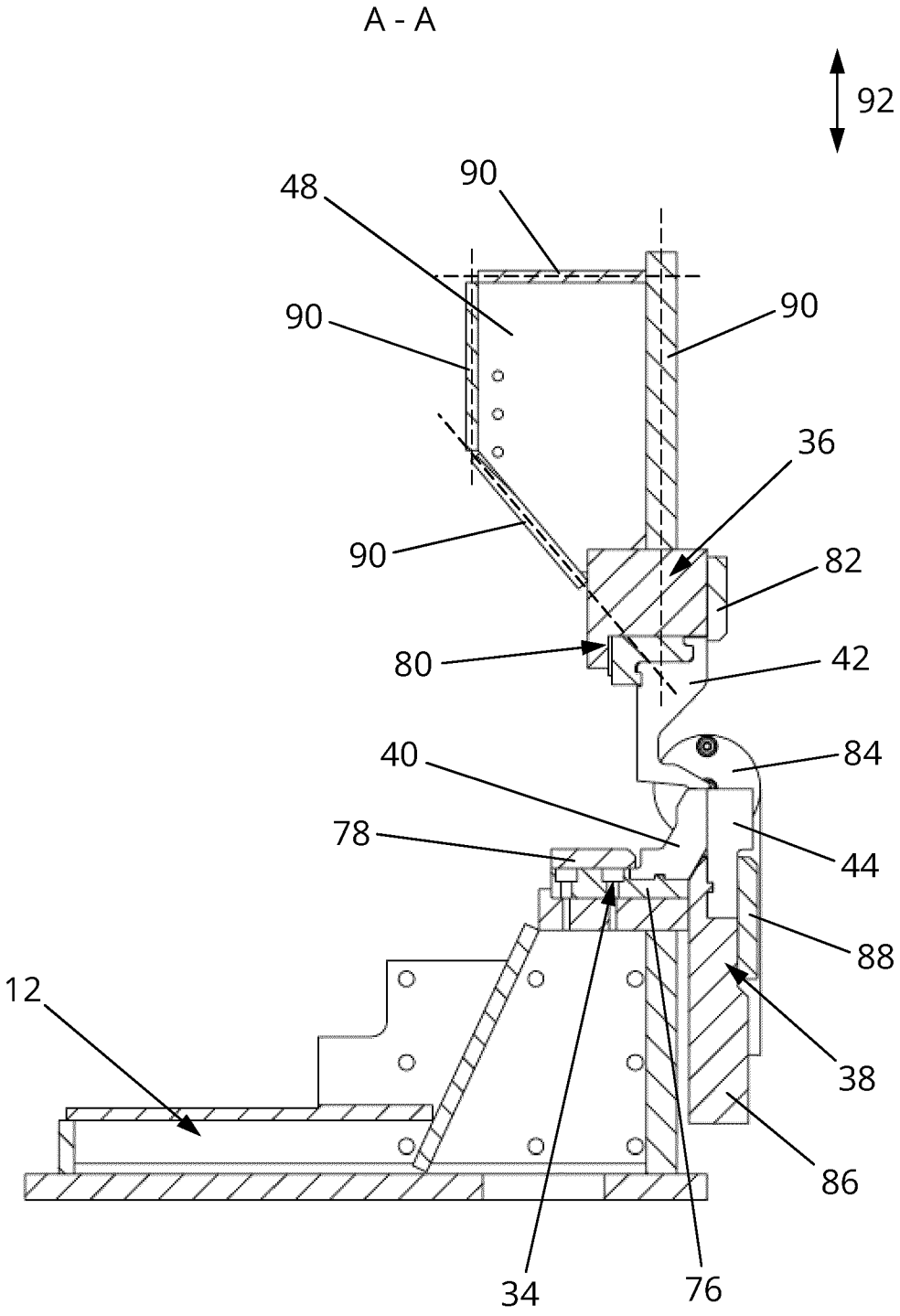
FIG. 5 is a sectional view of the machine body and the tool holders along the line A-A according to FIG. 3.

FIG. 5 is a sectional view of the machine body 48 and the lower tool holder 34, the upper tool holder 36 and the pivotable tool holder 38 along the line A-A according to FIG. 3. The machine body 48 has a substantially trapezoidal or diamond-shaped cross section. In the present embodiment, the cross section of the machine body 48 is designed as a substantially right-angled trapezoid. This cross section is substantially formed by the side faces or side elements 90 of the machine body 48 and illustrated with the aid of the dashed lines in FIG. 5. Two of the side faces/side elements 90 of the machine body 48 are fastened to the upper tool holder 36, for example by means of a screw or weld connection.

A side face/side element 90 of the machine body 48 is arranged parallel to the advancing direction 92 of the upper tool holder 36 and is perpendicular on top of the upper tool holder 36 (in FIG. 5 the right side face/element 90). Furthermore, in the embodiment shown according to FIG. 5, two side faces/side elements 90 of the machine body 48 are aligned parallel to one another and arranged opposite one another (in FIG. 5, the left and right side faces/side element 90). The side face/side element 90 of the machine body 48 that is perpendicular on top of the upper tool holder 36 is designed as a press beam. This side face or this side element 90 of the machine body 48 therefore has a greater width or thickness in cross section compared to the other side faces/side elements 90 of the machine body 48. Due to the more solid design of the side face/side element 90 which is perpendicular on top of the upper tool holder 36, bending forces occurring in the advancing direction 92 (direction of movement of the upper tool holder 36) can be optimally absorbed.

The lower side face/side element 90 of the machine body 48 extends substantially transversely/obliquely (that is, at an angle) with respect to the advancing direction 92 of the upper tool holder 36, whereby transverse forces that occur, for example, during a pivoting operation of the pivotable tool holder 38, can be optimally absorbed. In the present embodiment according to FIG. 5, the upper tool holder 36 forms part of the machine body 48. This part is designed to absorb forces running substantially transversely/obliquely and/or horizontally (that is to say forces which are transverse/oblique or perpendicular to the advancing direction 92). It also contributes to the stability of the machine body 48. This part is, at least in sections, perpendicular to the advancing direction 92 of the upper tool holder 36 and, at least in sections, perpendicular to the side face/side element 90 of the machine body 48 that is perpendicular on top of the upper tool holder 36. In the present embodiment, this part is also formed at least in sections parallel to an opposite side face/side element 90 of the machine body 48.

In cross section, the machine body 48 defines a parallelogram of forces, wherein at least one side length of the parallelogram of forces runs parallel to a side face or a side element 90 of the machine body 48. In the present embodiment, three side faces/side elements 90 of the machine body 48 (in FIG. 5 the left, right and lower oblique side face/side element 90) each define a side length of the parallelogram of forces. The machine body 48 is therefore designed to absorb the bending and/or pressing forces occurring during a folding process and the bending and/or pressing forces occurring during a die bending process. The above-described part of the upper tool holder 36, which forms a part of the machine body 48, can run or be arranged parallel to one side of the parallelogram of forces.

The following FIGS. 6*a* to 6*g* show further variants of the machine body 48 schematically in a cross sectional illustration.

Thus, FIG. 6*a* shows a variant of the machine body 48 in which the side faces/side elements 90 of the machine body 48 are not arranged parallel to one another. In this variant, only the right side face/side element 90 of the machine body 48 in FIG. 6*a* is arranged parallel to the advancing direction 92 of the upper tool holder 36. This side face/side element 90 can in turn be designed as a press beam and can stand perpendicular on top of the upper tool holder 36. Here, in contrast to the variant according to FIG. 5, the left side face/side element 90 opposite the right side face 90 or the right side element 90 is arranged obliquely.

The variant of the machine body 48 shown in FIG. 6*b* substantially corresponds to the variant according to FIG. 6*a*, but has a support structure 94. The support structure 94 can be designed as a support strut or support plate. For example, a support plate can have a rectangular or triangular shape. The support structure 94 can be attached to the outer surface of the machine body 48 or inside the machine body 48. Furthermore, in FIG. 6*b* the support structure 94 connects the upper and lower side faces/side elements 90 of the machine body 48 to one another. In the present variant according to FIG. 6*b*, the support structure 94 is arranged parallel to the right side face/side element 90, which is perpendicular on top of the upper tool holder 36. The machine body 48 can have a plurality of support structures 94.

FIG. 6*c* shows a further variant of the machine body 48 in which the side faces/side elements 90 of the machine body 48 form a square or rectangle in cross section. In this variant, the opposite side faces/side elements 90 are arranged parallel to one another. Here, too, the right side face/side element 90 of the machine body 48 illustrated in FIG. 6*c* is perpendicular to the upper tool holder 36.

FIG. 6*d* shows a further variant of the machine body 48, the side faces/side elements 90 of the machine body 48 defining or spanning a parallelogram (rhomboid) in cross section, in which the opposite sides are arranged in parallel. The parallelogram spanned by the side faces/side elements 90 of the machine body 48 slopes obliquely backwards (to the left in FIG. 6*a*) into the interior of the combination machine 10. The parallelogram spanned by the side faces/side elements 90 of the machine body 48 also defines the parallelogram of forces described above. The right side face/side element 90 of the machine body 48 shown in FIG. 6*d* is also designed here as a press beam, albeit to a somewhat reduced or more compact extent. The press beam is in turn perpendicular on top of the upper tool holder 36.

FIGS. 6*e* and 6*f* show two variants of the machine body 48 in which the side face/side element 90 of the machine body 48 arranged on the upper side of the upper tool holder 36 (in FIGS. 6*e* and 6*f*, the right side face/side element 90) is not perpendicular on top of the upper tool holder 36 but is inclined at an angle 98 to the perpendicular 96. The perpendicular 96 is parallel to the advancing direction 92 of the upper tool holder 36. This side face/side element 90 of the machine body 48 is preferably inclined rearwards into the interior of the combination machine 10. The angle 98 can be between 0 degrees and 45 degrees. In one embodiment, the angle 98 is between 5 degrees and 30 degrees, for example 15 degrees. The lower side face/side element 90 of the machine body 48 can run transversely or obliquely (FIG. 6*e*) or perpendicularly (FIG. 6*f*) relative to the perpendicular 96.

Another variant of the machine body 48 is shown in FIG. 6*g*. This variant substantially corresponds to the embodiment shown in FIG. 5, but has one (alternatively a plurality of) support structure(s) 94 arranged inside the machine body 48, for example a support strut or support plate. In the present embodiment, the support structure 94 is arranged parallel to a side face/a side element 90 of the machine body 48. Furthermore, the support structure 94 is arranged transversely or obliquely with respect to the advancing direction 92 of the upper tool holder 36. The support structure 94 connects the side face/side element 90 of the machine body 48 that is perpendicular on top of the upper tool holder 36 with at least one side face/side element 90 of the machine body 48 that is opposite it and/or adjoining it. The support structure 94 defines a side length of a parallelogram of forces 95. The parallelogram of forces 95 can correspond to the parallelogram of forces described above, for example with reference to FIG. 5. In the present embodiment, three side faces/side elements 90 of the machine body 48, namely in FIG. 6*g*, the left side face/the left side element 90, at least a part of the right side face/the right side element 90 and the inclined lower side face/side element 90 each define, in cross section, one side of the parallelogram of forces 95. Through this arrangement of the side faces/side elements 90 and the support structure 94, the machine body 48 can optimally absorb the bending forces occurring in the advancing direction 92 of the upper tool holder 36 and the bending forces occurring during a pivoting process of the pivoting tool holder 38 depending on the progress of a bending process.

Different variants of the bending tools arranged in the tool holders 34, 36 and 38 of the combination machine 10 will now be described with reference to FIGS. 7 to 10.

FIG. 7 shows a sectional view of a first variant of bending tools arranged in the tool holders 34, 36 and 38 of the combination machine 10. The lower bending tool 40 is designed as a lower beam tool and is releasably arranged on the lower tool holder 34. The lower beam tool 40 defines a workpiece support plane 98, which is shown schematically in FIG. 7 by a dashed line. The workpiece support plane 98 is oriented horizontally. The upper bending tool 42 is designed as an upper beam tool which can be advanced in the advancing direction 92 up to a gap S equal to the thickness of a workpiece. The upper bending tool 42 is releasably arranged on the upper tool holder 36. The upper beam tool 42 is substantially L-shaped in cross section. Furthermore, the upper beam tool 42 has a bending edge 100 which has a defined and/or predetermined radius. This radius can be selected depending on the bending radius and/or workpiece. The bending tool 44 to be pivoted is designed as a bending beam tool and is releasably arranged on the pivotable tool holder 38. As can be seen in FIG. 7, a working surface (surface with which the bending beam tool comes into contact with the workpiece) of the bending beam tool 44 lies in a starting position in the workpiece support plane 98 defined by the lower beam tool 40. The pivot axis 46 of the pivotable tool holder 38 or of the bending beam tool 44 is parallel to the bending edge 100 of the upper beam tool 42. In the present embodiment, the pivot axis 46 lies in the workpiece support plane 98.

The lower beam tool 40 is arranged with its front edge facing the bending beam tool 44 set back relative to the bending edge 100 of the upper beam tool 42. The lower beam tool 40 is designed to be stationary. With the lower beam tool 40 stationary, the bending beam tool 44 can be adjusted in the workpiece support plane 98 at right angles to the bending edge 100 of the upper beam tool 42 in a direction away from the lower beam tool 40 (to the left in FIG. 7) by a distance dependent on the progress of a folding process.

According to the variant shown in FIG. 7, the upper beam tool 42 has a central shaft section 102 arranged parallel to the advancing direction 92. At one end of the shaft section 102, a wedge-shaped leg 104 extends transversely or at an angle to the shaft section 102 and forms the upper beam with its bending edge 100. At the other end of the shaft section 102, a holding structure 106 is designed such that the upper beam tool 42 can be releasably attached to the holder rail 80 of the upper tool receptacle 36. For this purpose, the holder rail 80 of the upper tool receptacle 36 has a hook element 108 on which the upper beam tool 42 can be hooked. The holding structure 106 of the upper beam tool 42 has at least one, in the present embodiment two, hook sections 109. The hook sections 109 of the upper beam tool 42 engage in complementarily designed receiving structures of the hook element 108 of the holder rail 80. The upper beam tool 42, which is hooked into the hook element 108, can then be releasably fixed to the upper tool holder 36 by clamping by means of a clamping jaw 82. The clamping jaw 82 can be fixed to the upper tool holder by means of screws.

The lower beam tool 40 is releasably secured by clamping by means of a clamping jaw 78 to the holder rail 76 of the lower tool mounting 34. The clamping jaw 78 can be fastened to the holder rail 76 of the lower tool holder 34 by means of screws, not shown in FIG. 7.

The bending beam tool 44 is releasably fixed by clamping by means of a clamping jaw 88 on the holder rail 86 of the pivotable tool holder 38. The clamping jaw 88 can be fastened to the holder rail 86 of the pivotable tool holder 38 by means of screws (not shown in FIG. 7).

A further variant of the upper beam tool 42 is shown in FIG. 8. In contrast to the embodiment of the upper beam tool 42 shown in FIG. 7, the upper beam tool 42 shown in FIG. 8 has a middle shaft section 102 running transversely or obliquely to the advancing direction 92 of the upper tool holder 36. The middle shaft section 102 of the upper beam tool 42 is preferably oriented substantially in the direction of the bending beam tool 44. This enables better accessibility of the workpieces which are to be bent or are bent.

In FIG. 9, a further variant of the upper beam tool 42 is shown. This variant is now a combination of the upper beam tool 42 according to FIG. 7 and the upper beam tool 42 according to FIG. 8. The middle shaft section 102 of the upper beam tool 42 here has both a straight section, which is aligned parallel to the advancing direction 92, and a section running transversely or obliquely with respect to the advancing direction 92.

A further alternative of bending tools is described with reference to FIG. 10. In the present embodiment according to FIG. 10, the lower bending tool 40 is designed as a die (swage). The upper bending tool 42 is designed as a bending punch 42 that can penetrate into the die 40. The die 40 has a V-shaped recess 110 into which the bending punch 42 can penetrate, as shown in FIG. 10. Alternatively, the die 40 can have a U-shaped or semicircular recess. Furthermore, the die 40 defines the workpiece support plane 98 with its V-shaped end. The bending punch 42 has a bending punch tip 112 which is designed to be complementary to the die 40 or to the V-shaped recess 110 of the die 40.

The die 40 is releasably and replaceably arranged on the lower tool holder 34. The bending punch 42 is releasably and replaceably arranged on the upper tool holder 36. The combination machine 10 has at least one first adapter piece 114. The first adapter piece 114 is designed to releasably fix a lower bending tool 40, the die 40 in the present embodiment according to FIG. 10, to the lower tool holder 34. At least a part of the first adapter piece 114 is designed to be complementary to at least a part of the holder rail 76 of the lower tool holder 34 in such a way that a releasable connection (in the present embodiment a clamp connection) can be established between the first adapter piece 114 and the holder rail 76 of the lower tool holder 34. The first adapter piece 114 is releasably secured by clamping by means of the clamping jaw 78 to the holder rail 76 of the lower tool holder 34. The first adapter piece 114 has a clamping means 116 with a clamping jaw for releasably fixing or securing the die 40. At its end opposite the V-shaped recess 110, the die 40 has a holding pin which can be clamped between the first adapter piece 114 and the clamping jaw 116. The clamping jaw 116 is fixed to the first adapter piece 114 by means of a screw connection in order to clamp the holding pin of the die 40.

The combination machine 10 additionally has at least one second adapter piece 118. The second adapter piece 118 is designed to releasably and replaceably fix an upper bending tool 42, in the present embodiment according to FIG. 10 the bending punch 42, on the hook element 108 of the holder rail 80 of the upper tool holder 36. At least part of the second adapter piece 118 is complementary to at least a part of the hook element 108 of the upper tool holder 36 in such a way that a releasable clamp connection can be established between the second adapter piece 118 and the upper tool holder 36 or the hook element 108 of the upper tool holder 36. The second adapter piece 118 is releasably secured by clamping by means of the clamping jaw 82 to the hook element 108 of the holder rail 80 of the upper tool holder 36. The second adapter piece 118 has a clamping means 120 with a clamping jaw for releasably fixing or securing the bending punch 42. At its end opposite the V-shaped bending punch tip 112, the bending punch 42 has a holding pin which can be clamped between the second adapter piece 118 and the clamping jaw 120. The clamping jaw 120 is fixed to the second adapter piece 118 by means of a screw connection in order to clamp the holding pin of the bending punch 42.

The embodiments described above can be combined with one another in any way. The embodiments therefore show possible design variants that do not restrict the invention to the specifically illustrated design variants. Rather, various combinations of the individual embodiments with one another and variations of the embodiments are also possible. Furthermore, suitable machine controls, drives and guides for the combination machine 10 are known to a person skilled in the art and are therefore not explained in more detail here.

REFERENCE NUMERALS

10 combination machine
12 machine frame
14 lower part
16 upper part
18 main switch
20 foot rest
22 foot pedal
24 hand rest
26 pressure switch
28 casing
28*a* left casing part
28*b* right casing part
28*c* middle casing part
30 ventilation holes or slots
32 display device
34 lower tool holder
36 upper tool holder
38 pivotable tool holder
40 lower bending tool
42 upper bending tool
44 bending tool to be pivoted
46 pivot axis
48 machine body
50 side upright
51 base plate
52 holding plates
54 recess
56 first drive device
58 electric motors of the first drive device
60 gear of the first drive device
62 ball screw drives of the first drive device
64 second drive device
68 electric motors of the second drive device
70 gear of the second drive device
72 electric motors of the stop unit
74 electric motor for advancing the pivotable tool holder
76 holder rail of the lower tool holder
78 clamping means of the lower tool holder
80 holder rail of the upper tool holder
82 clamping means of the upper tool holder
84 pivot lever
86 holder rail of the pivotable tool holder
88 clamping means of the pivotable tool holder
90 side faces/side elements of the machine body
92 advancing direction
94 support structure
95 parallelogram of forces
96 perpendicular
98 workpiece support plane
100 bending edge
102 middle shaft section of the upper beam tool
104 wedge-shaped leg of the upper beam tool
106 holding structure of the upper beam tool
108 hook element
109 hook sections
110 V-shaped recess of the die
112 bending punch tip
114 first adapter piece
116 clamping means of the first adapter piece
118 second adapter piece
120 clamping means of the second adapter piece

What is claimed is:

1. A combination machine for folding and die bending a workpiece, the machine comprising:

a lower tool holder configured to releasably receive at least one lower bending tool;

an upper tool holder configured to releasably receive at least one upper bending tool, and to be advanced in a straight line in an advancing direction toward the lower tool holder;

a pivotable tool holder configured to releasably receive at least one bending tool which is to be pivoted, the pivotable tool holder pivotable relative to the lower tool holder about a pivot axis running perpendicular to the advancing direction of the upper tool holder; and a machine body on which the upper tool holder is arranged;

the machine body defining a parallelogram structure in cross-section, the parallelogram structure comprising a plurality of side elements positioned above the upper tool holder and aligned with the advancing direction of the upper tool holder, and respective upper and lower elements extending obliquely to the advancing direction of the upper tool holder;

such that the machine body is configured to absorb bending forces occurring in the advancing direction of the upper tool holder and bending forces occurring during a pivoting process of the pivotable tool holder, depending on the progress of the bending process.

2. The combination machine of claim 1, wherein the machine is configured for folding and die bending sheet metal.

3. The combination machine of claim 1, wherein the machine body is configured to absorb at least one of bending or pressing forces occurring during a folding process, and to absorb at least one of bending or pressing forces occurring during a die bending process.

4. The combination machine of claim 1, further comprising:

a first drive device couplable to the upper tool holder to transmit a force;

whereby the upper tool holder is configured to exert a substantially perpendicular force on the workpiece in the advancing direction.

5. The combination machine of claim 4, wherein the first drive device comprises at least one of an electric motor, a pneumatic unit, or a hydraulic unit for raising and lowering the upper tool holder.

6. The combination machine of claim 1, wherein:

the lower bending tool is configured as a die; and the upper bending tool is configured as a bending punch that is operable to penetrate into the die;

wherein the die is releasably arranged on the lower tool holder, and the bending punch is releasably arranged on the upper tool holder.

7. The combination machine of claim 1, further comprising:

a second drive device couplable to the pivotable tool holder for the transmission of a force;

wherein the pivotable tool holder is pivotable about the pivot axis relative to the lower tool holder by the second drive device and is configured to exert a force on the workpiece based on the progress of the folding process.

8. The combination machine of claim 7, wherein the second drive device comprises at least one of an electric motor, a pneumatic unit, or a hydraulic unit.

9. The combination machine of claim 1, wherein:

the lower bending tool is configured as a lower beam tool;

the upper bending tool is configured as an upper beam tool that is advanceable in the advancing direction up to a gap that is equal to the thickness of the workpiece; and the bending tool to be pivoted is configured as a bending beam tool;

the lower beam tool is releasably arranged on the lower tool holder;

the upper beam tool is releasably arranged on the upper tool holder; and the bending beam tool is releasably arranged on the pivotable tool holder.

10. The combination machine of claim 9, wherein, with the lower beam tool stationary, the bending beam tool is adjustable in a workpiece support plane at right angles to a bending edge of the upper beam tool, in a direction away from the lower beam tool, by a distance based on the progress of a folding process.

11. The combination machine of claim 1, wherein the lower tool holder and the pivotable tool holder are arranged on a slide that is moveable relative to the upper tool holder.

12. The combination machine of claim 1, wherein the machine body is held or is securable on two lateral uprights of a machine frame.

13. The combination machine of claim 1, wherein the machine body has a substantially trapezoidal or diamond-shaped cross-section.

14. The combination machine of claim 1, wherein the machine body includes at least one side face or at least one side element arranged parallel to the advancing direction of the upper tool holder.

15. The combination machine of claim 1, wherein the machine body includes at least one side face or at least one side element extending perpendicularly from the top of the upper tool holder.

16. The combination machine of claim 15, wherein the side element or side face that extends perpendicularly from the top of the upper tool holder is configured as a press beam.

17. The combination machine of claim 1, wherein the lower tool holder, the upper tool holder, and the pivotable tool holder each comprises at least one clamping means configured for releasably fixing the respective bending tool.

18. The combination machine of claim 17, wherein each clamping means comprises a clamping jaw configured to releasably secure the respective bending tool by clamping.

19. The combination machine of claim 1, further comprising at least one of:

at least one first adapter piece configured to releasably fix a lower bending tool to the lower tool holder; or at least one second adapter piece configured to releasably fix an upper bending tool to the upper tool holder.

20. The combination machine of claim 19, wherein at least one of:

the lower bending tool is a die; or the upper bending tool is a bending punch.

21. The combination machine of claim 19, wherein at least a part of the first adapter piece or the second adapter piece is configured to be complementary to at least a part of the lower tool holder or the upper tool holder in such a way that a releasable clamp connection can be established between the first adapter piece or the second adapter piece and the lower tool holder or the upper tool holder.

22. The combination machine of claim 19, wherein at least one of the first adapter piece or the second adapter piece comprises clamping means configured for releasably fixing or securing the respective bending tool.

23. A method of die bending a workpiece, the method comprising:

obtaining a machine for folding a workpiece, the machine comprising:

a lower tool holder configured to releasably receive at least one lower bending tool, an upper tool holder configured to releasably receive at least one upper bending tool, and to be advanced in a straight line in an advancing direction toward the lower tool holder, a pivotable tool holder configured to releasably receive at least one bending tool which is to be pivoted, the pivotable tool holder pivotable relative to the lower tool holder about a pivot axis running perpendicular to the advancing direction of the upper tool holder, and a machine body on which the upper tool holder is arranged, the machine body defining a parallelogram structure in cross-section, the parallelogram structure comprising a plurality of side elements positioned above the upper tool holder and aligned with the advancing direction of the upper tool holder, and respective upper and lower elements extending obliquely to the advancing direction of the upper tool holder;

placing a workpiece in the machine for operative engagement with at least one of:

at least one lower bending tool received in the lower tool holder, at least one upper bending tool received in the upper tool holder, or at least one pivotable bending tool received in the pivotable tool holder; and actuating with a drive of the machine, at least one of the lower tool holder, the upper tool holder, or the pivotable tool holder to thereby die bend the workpiece.

* * * * *